United States Patent [19]

Gratsch

[11] Patent Number: 4,589,644

[45] Date of Patent: May 20, 1986

[54] COMBINATION CLOTH SPREADING MACHINE AND COMPLEMENTARY MOVING KNIFE

[76] Inventor: Jack M. Gratsch, 6220 Britton Ave., Cincinnati, Ohio 45227

[21] Appl. No.: 755,185

[22] Filed: Jul. 15, 1985

Related U.S. Application Data

[63] Continuation-in-part of Ser. No. 642,378, Aug. 20, 1984, Pat. No. 4,529,186.

[51] Int. Cl.[4] ..... B65H 29/46

[52] U.S. Cl. ..... 270/31; 68/8

[58] Field of Search ..... 270/30–31; 101/382 MV; 68/5 B, 8

[56] References Cited

U.S. PATENT DOCUMENTS

| | | | |
|---|---|---|---|
| 3,479,023 | 11/1969 | Martin, Sr. et al. | 270/31 |
| 3,672,661 | 6/1972 | Gerber et al. | 270/31 |
| 3,684,273 | 8/1972 | Benson et al. | 270/31 |
| 3,782,649 | 1/1974 | Frederick et al. | 270/31 |
| 3,817,513 | 6/1974 | Frederick | 270/31 |
| 4,339,118 | 7/1982 | Burton et al. | 270/31 |
| 4,355,794 | 10/1982 | Costigan | 270/31 |
| 4,380,330 | 4/1983 | Smith | 270/31 |
| 4,477,065 | 10/1984 | Smith | 270/31 |

*Primary Examiner*—E. H. Eickholt
*Attorney, Agent, or Firm*—Frost & Jacobs

[57] ABSTRACT

A machine for spreading and severing cloth from a roll, the machine including an expansible perforated endless belt for conveying the cloth from the roll, a vacuum system for drawing a vacuum through said perforated endless belt, the perforated endless belt having a cloth carrying and return flight, said cloth carrying flight capable of condensing said cloth, and cutter knife means to sever said cloth as desired. The cutter means may be a cutter knife or a cutter hot wire.

16 Claims, 6 Drawing Figures

COMBINATION CLOTH SPREADING MACHINE AND COMPLEMENTARY MOVING KNIFE

The present application is a continuation-in-part of U.S. Ser. No. 642,378, filed Aug. 20, 1984, now U.S. Pat. No. 4,529,186.

BACKGROUND OF THE INVENTION

1. Field of the Invention

This invention relates to a combination of a cloth spreading machine and a complementary moving cutter knife, and more particularly to cloth spreading machines of the type which move longitudinally and reciprocally over a cloth spreading table and spread layers of cloth upon the table whereupon a complementary moving knife severs the cloth to form a plurality of separate single layers of cloth stacked one upon another.

2. Prior Art

Reciprocating cloth spreaders are well known in the art and have been in use for many years. The U.S. patents to Martin, et al (U.S. Pat. No. 3,472,023) and Benson et al (U.S. Pat. No. 3,684,282) illustrate the general features of this type of machine. In laying or spreading cloth from a roll, the ideal goal is to place a layer of cloth upon a table which is straight, smooth (flat) and tension free so that material usage is maximized.

Tension exists in a roll of cloth due to the manner in which the cloth is rolled on a spindle at the textile mill. Certain prior art references describe efforts toward producing a tension free lay of cloth; U.S. patents to Benson et al, previously mentioned, and to Frederick et al (U.S. Pat. No. 3,782,649) underscore this fact. However, solutions proposed to date have been largely unsatisfactory because prior art devices generally operate on an "on-off" system so that response to overfeeding or underfeeding is abrupt and jerky. Although efforts have been made to smooth the movement and prevent the abrupt jerky motion, the prior art does not disclose a truly effective means to eliminate this tension. Because the prior art devices do not eliminate the tension in the cloth, the cloth cannot be cut in an even manner.

Generally, prior art cutters transversely reciprocate in a cutter slide. Thus, when the cloth spreading machine completes a lay of cloth, it must stop in order to permit the cloth cutter to sever the cloth. Accordingly, it is apparent that spreading cloth in the manner taught by prior art devices is time consuming.

SUMMARY OF THE INVENTION

The cloth spreading machine of the present invention produces a tensionless in-line lay of cloth. In particular, cloth having a selvage tends to spread from a machine in a curved manner, that is, the cloth curves to the tight selvage edge. To this end, the cloth spreading machine of the present invention conveys the cloth in a tensionless manner from a bolt or spindle of cloth, as is typically produced by a fabric mill, to a perforated, expansible belt, in which a vacuum is drawn within the interior of the belt, and from the endless expansible belt to a table upon which the cloth is laid. A difference in circumferential speed of the rollers around which the endless belt traverses produces a contraction section within the belt. Since the belt is perforated, the cloth is tightly drawn against the belt by the vacuum and when the cloth passes through the contraction or condensing portion of the belt, the tension in the web of the cloth is eliminated and a smooth lay of cloth is produced.

The vacuum system also maintains the straight edge alignment of the lay. As the web of cloth is drawn from the roll, the edge position is sensed and adjustments are made to correct the position of the cloth prior to its contact with the belt. The cloth remains in contact with the belt/vacuum arrangement until it is laid upon the spreading table or upon a previous lay of cloth.

The improved features of the cloth laying machine of the present invention include a steamer pad designed to quickly steam the material prior to its entry onto the contraction section of the endless belt so as to aid in the relaxation of the stress or tension in the cloth.

Another improvement of the present invention which aids in relaxing the stress or tension of the cloth is the incorporation of one or more jiggle rollers around which the cloth passes as soon as it is unwound from the spindle or bolt of cloth. The jiggle rollers are axially reciprocated across the transverse direction (the width of the cloth) to aid in relieving the stress. If more than one jiggle roller is employed, the rollers may be reciprocated in opposite directions, that is, out of sequence with one another in order to prevent the cloth from shifting to one side or the other of the cloth spreading machine during operation.

Yet another improvement to the cloth spreading machine is the inclusion of a cutter knife designed to reciprocate transversely (width-wise) with respect to the cloth in order to cut the cloth and return the cutter to its original starting position at one edge of the cloth. Additionally, the cutter and cutter slide shift in the direction of the path of the cloth at a speed equal to the speed of the cloth. This improvement enables the cloth to be cut while the cloth continues to be spread from the spreading machine spindle to the table. Moreover, the cloth is cut in a straight manner so that there is no need to stop the machine, as in conventional cloth spreading machines, to enable the cutter to perform its designed function.

Another feature of the present invention over that of the parent U.S. Pat. No. 4,529,186 is a new improved cloth spreading machine of a different modification in which the contraction section of the cloth spreading machine terminates directly at the table.

In the broadest sense, the present invention comprises a cloth spreading machine having means to support a roll of cloth as it comes from a textile mill; a feed roller to control the rate at which the cloth is removed from the roll or supply of cloth; first and second tension adjustment rollers; a perforated endless belt; the perforated belt passing about the feed roller and the tension adjustment rollers with a non-slipping engagement forming cloth carrying and return flights therebetween; the second tension adjustment roller being shiftably mounted between a normal position adjacent the return flight and an actuated position engaging and stretching the return flight; means to shift the second tension adjustment roller between the normal and actuated positions; means to drive the feed roller; a friction clutch in association with the first tension adjustment roller so that the first tension adjustment roller is rotated by the belt only; whereby when the second adjustment roller is shifted from the normal position to the actuated position, the return flight of the belt is stretched, and when the second adjustment roller is returned to its normal position, the first adjustment roller is momentarily stopped, causing the stretch of the return flight to be taken up by the feed roller causing slack to be created in the cloth carrying flight, converting the cloth carrying flight to the condensing portion, the improvement including a transversely reciprocating cutter knife designed to also travel in the direction of movement of the path of cloth, at the same speed thereof, thereby enabling the cutter knife to sever the cloth while the cloth is being spread.

Further advantageous features of the present invention can be obtained by referring to the drawing, detailed description and claims of the invention set forth below.

DETAILED DESCRIPTION OF THE PREFERRED EMBODIMENTS

Figure 1:
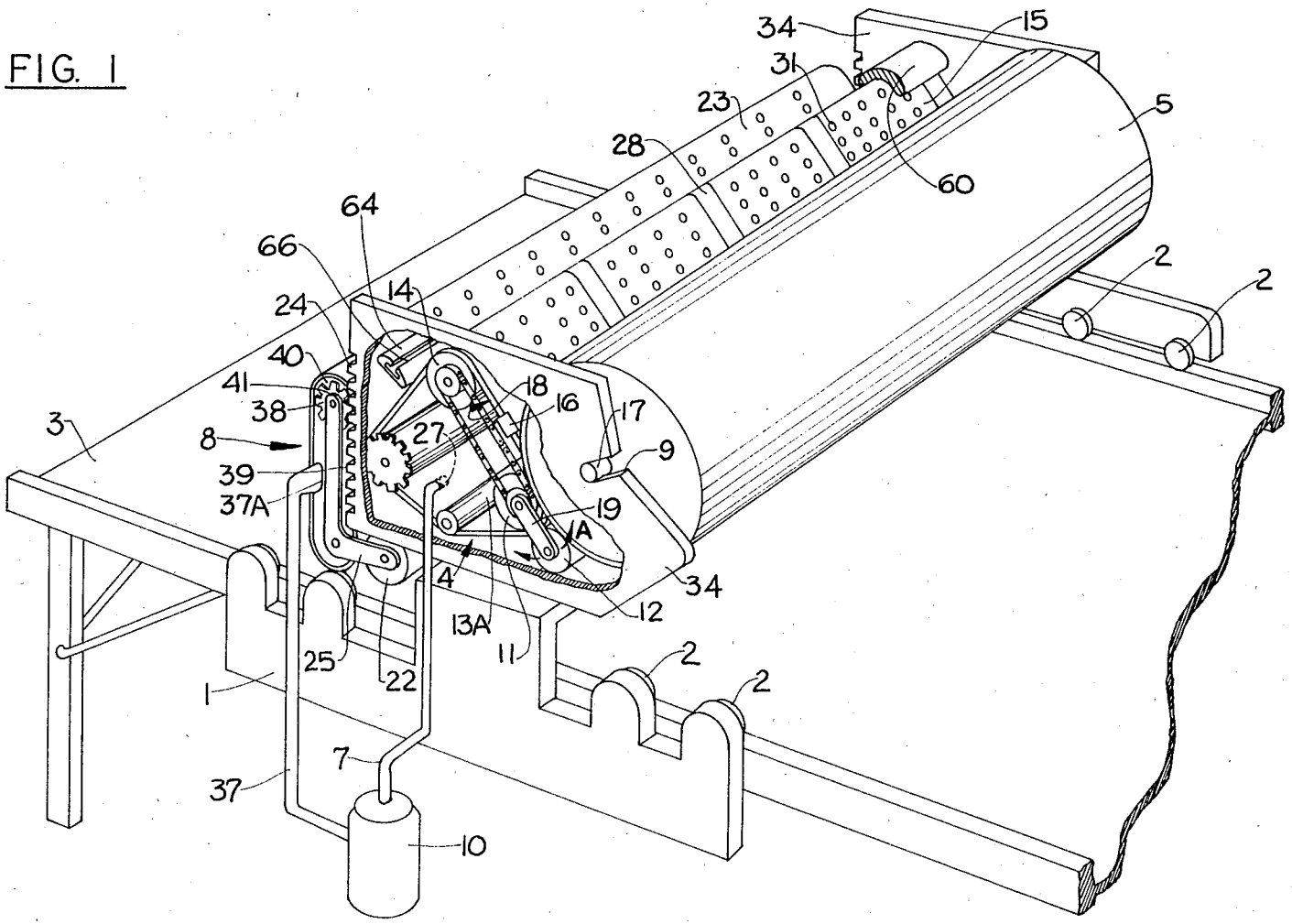
FIG. 1 is a semi-diagrammatic, fragmentary, perspective view of the cloth spreading machine of the present invention mounted on a spreading table.

As shown in FIG. 1, the cloth spreading machine of the present invention has a frame 1 mounted on wheels 2 for longitudinal movement over a spreading table 3. The wheels 2 are in tandem to eliminate table joint clicks, give positive traction at all times, and provide better movement of the frame 1. Mounted centrally on the frame 1 is a cloth supply feed mechanism, generally indicated by reference numeral 4, which is rotatable about a vertical axis with respect to frame 1 and provides support for a bolt 5 of cloth. The bolt 5 is typically the way textile mills supply cloth to users. A web 6 of cloth is fed from the bolt 5 through the feed mechanism 4, to a spreading unit, generally indicated at 8, where the cloth web 6 is spread upon the spreading table 3, in layers. The frame 1 is caused to move longitudinally over the table 3 by conventional means, such as by driving the wheels 2 through a chain and sprocket transmission (not shown) powered by the carriage drive motor (not shown).

The cloth supply feed mechanism 4 includes a loader throat 9, two feed rollers 11 and 12, two tension adjustment rollers 13*a* and 13*b*, a perforated carrier roller 14, a perforated expansible belt 15, means for drawing a vacuum (comprising a conduit 7 connected to a vacuum source 10) and edge control means 16. The loader throat 9 is essentially a slot-like channel formed in side walls 34 and designed to carry a center rod 17 which supports the bolt 5 of cloth. The throat 9 is slightly inclined to use the force of gravity to advance the bolt 5 against feed roller 11 as the web 6 is removed and the bolt 5 gets smaller. However, the angle of inclination is limited so that a heavy roll will not exert so great a force on the feed roller 11 so as to damage the cloth as it is removed.

The belt 15 encircles the two tension adjustment rollers 13*a* and 13*b*, the perforated carrier roller 14 and the feed roller 11. As shown diagrammatically in FIG. 2, rollers 11, 13*b* and 14 are positioned in a fixed triangular relationship, while the position of roller 13*a* is adjustable along the path indicated by arrow B. Roller 11 is driven by a direct power source, such as motor 32. Rollers 11 and 14 are interconnected by a chain 29 and sprockets 30 and 30*a* so that roller 14 is also driven, and so that rollers 11 and 14 will always rotate at the same speed. Roller 13*a* is an idler roller and freely rotates with the movement of the belt 15. Roller 13*b* also rotates with the belt 15 but has its rotational speed limited by a frictional clutch 33, shown diagrammatically in FIG. 2. Frictional clutch 33 may take any convenient and conventional form, and may even constitute a disk brake system or a torque converter. Thus, roller 13*b* will rotate only as fast as it is pulled by the belt 15. There is sufficient friction between the rollers 11, 13*a*, 13*b* and 14 and the belt 15 so that there is no slippage.

The belt 15 is described as expansible since it is necessary that the tension within the belt vary. When roller 13*a* is in an extreme lower position, as indicated by the broken outline at 13*a*′ in FIG. 2, the belt 15 is fully expanded; in this configuration, the belt 15 is, in a sense, inexpansible since it can be stretched no further, and the tension is uniform in the belt. To create the desired contraction section within the belt 15, roller 13*a* is moved from the position 13*a*′ to that shown at 13*a* in solid lines. Since there is no slippage between the rollers and the belt 15, the additional length released by moving roller 13*a*, initially creates a contraction section in the belt 15 between rollers 13*b* and 11. However, this "slackness" will cause the clutch mechanism in roller 13*b* to create a braking action and briefly decrease the rotational speed of roller 13*b*; this, in turn, causes the contraction to transfer to that section of the belt 15 between rollers 13*b* and 14. When the belt returns to its fully expanded condition between rollers 13*b* and 11, roller 13*b* will increase in rotational speed back to that of rollers 11 and 14, such that the contraction section of the belt remains between rollers 13*b* and 14.

Preferably, the belt is made of perforated elastic, perforated rubber or other similar perforated flexible material which permits a vacuum to be drawn through the belt, and will accomplish the necessary expansion and contraction. As illustrated in FIG. 1, the belt 15 has continuous limit straps 28, generally made of nylon, which are attached to the belt by zig-zag stitching or in any other suitable manner. Of course, the limit straps can be made of other synthetic type materials, such as rayon, dacron, or the like. The position of the limit strips on the belt 15 limits the ability of the belt to stretch and expand. The zig-zag stitching permits the limit straps to relax when the belt is less than fully expanded. The zig-zag stitching also permits the belt to expand to the limit of the straps without ripping the limit straps from the belt. In general, the position and exact number of limit straps depend upon the size of the cloth spreading machine. However, there is an advantage to having the edges of the belt terminate with limit straps, particularly when the rollers have slight grooves corresponding to the position of the limit straps. In such a situation, the limit straps and grooves help assure proper positioning of the belt as it traverses the rollers and tend to prevent shifting of the belt to the right or left.

In addition to the above characteristics, the belt is also permeable or porous due to openings 31 so that a vacuum may be drawn through the belt. Thus, any material placed upon the belt will be held in place by means of the vacuum, even if the belt changes its course of direction.

A vacuum means 10, including conduit 7, is provided to draw a vacuum from the volume defined by the expansible belt 15 and the side walls 34 through an opening 27 in one of the sidewalls 34. The belt 15 and roller 14 are perforated to allow ambient air to be drawn therethrough by the vacuum means. During the cloth spreading operation, it is preferred that the vacuum means only pull air through the roller 14 and the section of the belt 15 between rollers 14 and **13*b* (the contraction section of the belt 15). However, it may also be desirable to draw a vacuum between rollers 11 and 14 at the time of initial thread-up. This is done by means of an openable and closable shutter 18 positioned beneath the belt 15 and between rollers 11 and 14 so that the vacuum means may draw air through this section to aid in the threading of the web 6** of cloth through the cloth spreading machine when the shutter is open.

Figure 2:
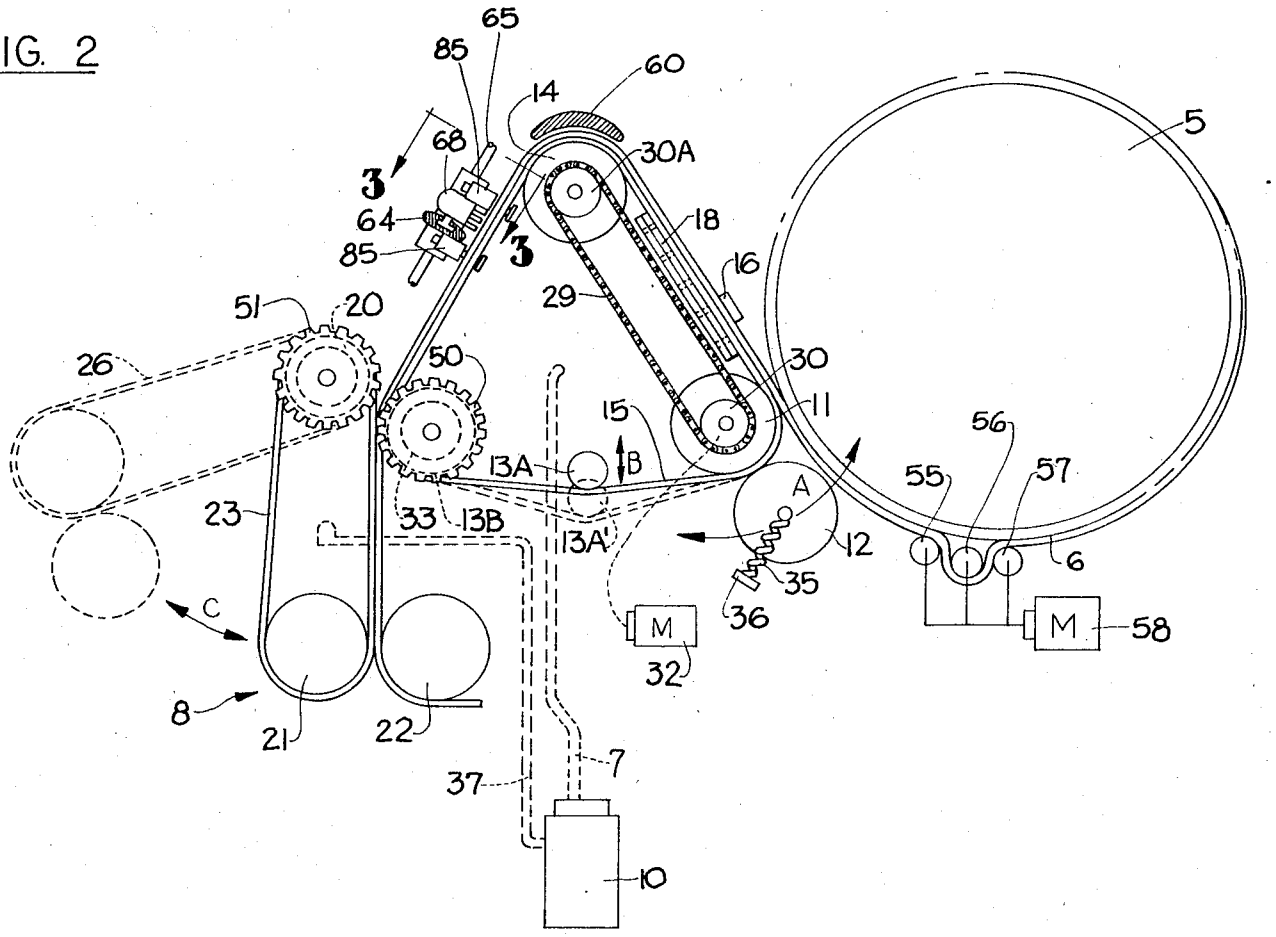
FIG. 2 is a diagrammatic side view of the cloth supply feed mechanism and spreading unit of FIG. 1.

The edge control means may comprise any conventional means, such as a pair of photoelectric sensor 16, only one of which is shown in FIG. 1. The edge control means is positioned over the section of the belt 15 between rollers 11 and 14, as shown in FIGS. 1 and 2. The edge control means 16 provides appropriate signals to means (not shown) to axially shift the bolt 5, as is known in the art (see U.S. Pat. No. 3,479,023 to Martin, for example). The pair of photoelectric sensors 16 are mounted over the belt and near each side edge, by a pair of supports (not shown). A turnbuckle shaft as illustrated and described in my copending application U.S. Ser. No. 642,378, herein incorporated by reference, (having oppositely threaded portions) mechanically couples both supports so that rotation of the turnbuckle shaft simultaneously shifts both photoelectric sensors 16 toward or away from one another. This assures that each photoelectric sensor is positioned the same distance from the center of the belt. The turnbuckle shaft may be driven by an operator or by a motor.

The feed roller 12 is spring loaded by positioning a pair of springs 35, one of which is shown in FIG. 2, against the axle of roller 12 and anchoring the spring to an appropriate portion 36 of the cloth supply feed mechanism 4. The feed roller 12 is connected to feed roller 11 by a pair of arms, one of which is shown at 19 (see FIG. 1), so that it will travel through an arc as indicated by arrow A. The springs 35 assure that the roller 12 will remain in constant contact with the bolt 5 of cloth and maintain sufficient pressure against the roll to provide proper feeding of the web 6 of cloth.

Near the front of the frame 1 and adjacent the cloth supply feed mechanism 4 is the spreading unit 8, consisting basically of three rollers 20, 21 and 22, a perforated belt 23, vacuum means 10 (including conduit 37) and elevator means 24. The perforated belt 23 is made of the same material as belt 15 and is generally the same width. Each edge of belt 23 includes indexing slots 49, as shown in FIG. 1. The perforated belt 23, mounted between a pair of end walls 40 (one of which is shown in FIG. 1), surrounds the rollers 20 and 21 which are a fixed distance one from the other. As illustrated in FIG. 2, roller 20 has a pair of sprockets 51 (one of which is shown) at each end of the roller. Roller **13*b* has a pair of sprockets 50 (one of which is shown) at each end of the roller. Sprockets 50 and 51 have diameters substantially the same as the diameters of their respective rollers 13*b* and 20. The spreading unit 8 is mounted adjacent the cloth supply mechanism 4 so that the indexing slots 49 of belt 23 securely engage the sprockets 50 of roller 13*b*. Moreover, slots 49 also engage sprockets 51. This assures that the rollers 20 and 21 will be driven by roller 13*b* and will rotate at the same speed as roller 13*b* through the agency of belt 23 and its indexing slots 49. Roller 22 is free wheeling and rotates because of its close contact with roller 21**.

A vacuum is applied to the volume bound by the belt 23 and end walls 40, by means of an opening **37*a* in one of the end walls 40 and conduit 37 connected to vacuum means 10. Thus, a vacuum is drawn through perforated belt 23 to hold the cloth on the belt. The two rollers 20 and 21 are connected by L-shaped connecting links 25 (one of which is illustrated in FIG. 1) to roller 22; the lower surface of roller 22 is on the same plane as that of roller 21 to provide for spreading cloth in either direction. The spreading unit 8 is made to swing outwardly from the position shown, as indicated by arrow C and the broken lines at 26 in FIG. 2, so that the machine may be rotated on its frame 1**, if desired.

Figure 4:
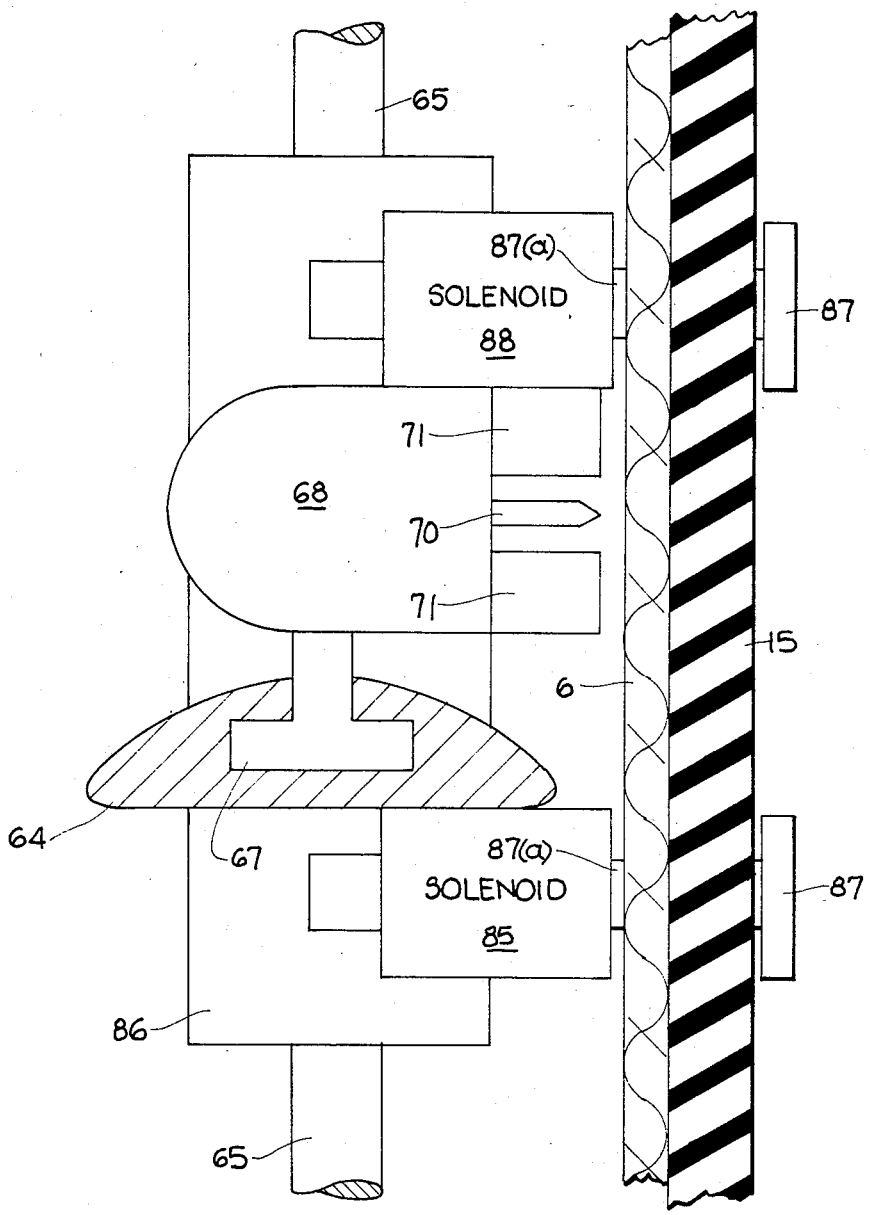
FIG. 4 is an enlarged diagrammatical side view of the endless belt, cutter slide and solenoid, positioned with respect to one another.

The elevator means 24 comprises a pair of pinion gears 38 and racks 39, one of which is shown in FIG. 1, to raise the spreading unit 8. The pair of pinion gears 38 freely rotate on shaft 41. The spreading unit is raised by means of a ratchet system, or a motor, or the like, not shown. Conventionally known ratchet systems are taught by U.S. Pat. Nos. 3,479,023 and 4,392,646 (FIG. 4).

The above description thus far presented corresponds significantly to my copending U.S. patent application Ser. No. 642,378, filed Aug. 20, 1984, now U.S. Pat. No. 4,529,186, herein incorporated by reference.

The cloth spreading machine of the present invention includes several major improvements. The first improvement concerns the use of a plurality of jiggle rollers 55, 56 and 57 (two or more can be employed) which reciprocate transversely across the width of the fabric cloth 6 so as to relieve tension or stress in the cloth as it is unwound from roller 5, as shown in FIG. 2. Preferably, the jiggle rollers 55–57 are made to reciprocate in opposite directions with respect to adjacent jiggle rollers. For example, roller 55 and 57 may be moved into the page, as viewed in FIG. 2, while roller 56 moves out of the page and vice versa. With the appropriate mechanism (not shown), rollers 55, 56 and 57 can be simultaneously driven by motor 58. Jiggle rollers 55–57 and motor 58 may be mounted on side walls 34, for example.

Another improved feature of the present invention is the employment of a steam sparger 60 shown in part in FIG. 1 and in cross section in FIG. 2. The steam sparger is mounted upon the top edge of sidewalls 34 and is positioned immediately above roller 14 so that the web of cloth 6 is steamed as it traverses around a segment of the circumference of roller 14. The steam issuing from the bottom surface of the steam sparger 60 lightly moistens the cloth which aids in relaxing the stress and tension in the cloth.

Figure 3:
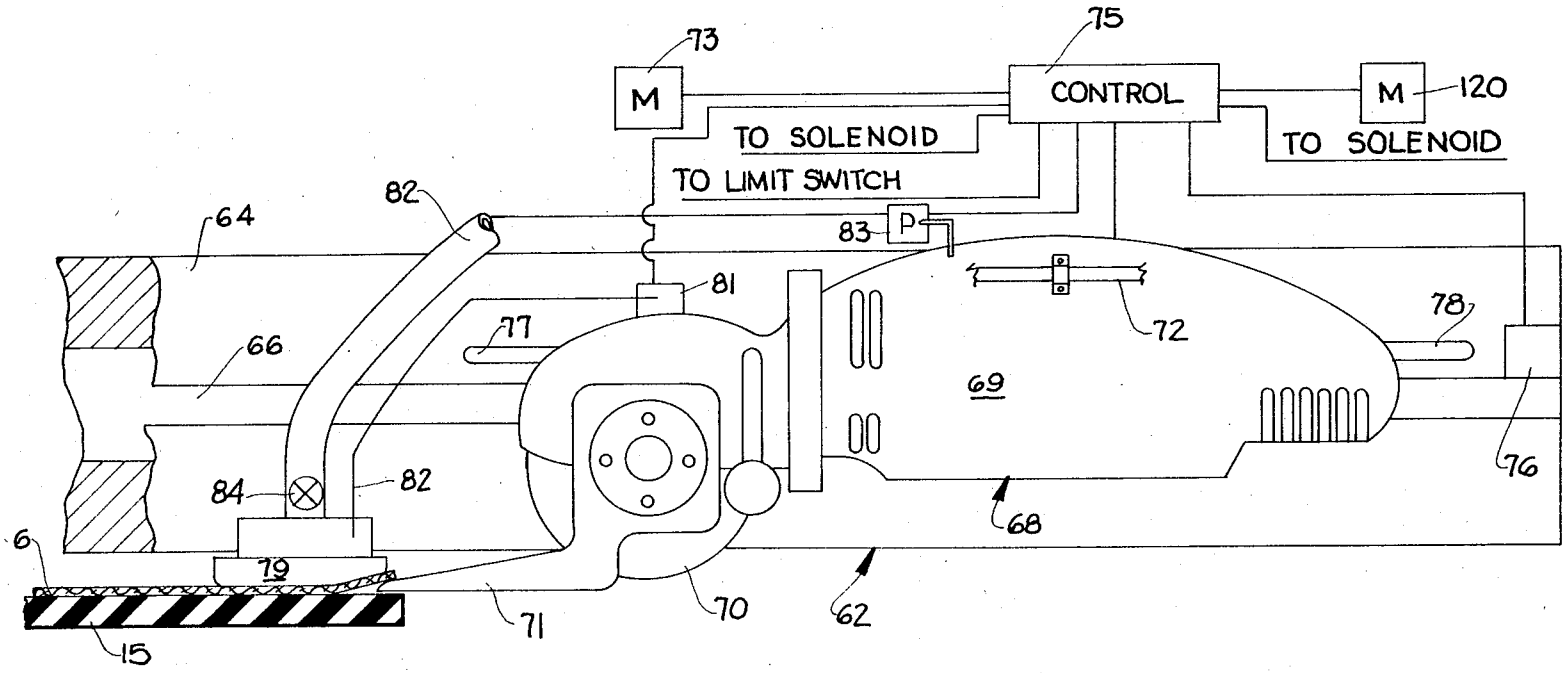
FIG. 3 is a fragmentary side view of the cutter and cutter slide with the associated vacuum pad as viewed from line 3—3 of FIG. 2.

A third improvement of the present invention comprises the use of a transversely and longitudinally moving cutter knife system as generally indicated by reference numeral 62, as illustrated in FIG. 3. The cutter knife system includes a cutter slide 64 as illustrated in FIGS. 1–3. The cutter slide is mounted on a pair of guide bars 65, only one of which is illustrated in FIGS. 2 and 4. The guide bars 65 are mounted on a frame support structure such as the sidewalls 34 and are positioned adjacent each end of the cutter slide 64. The guide bars are positioned so that they are parallel with one flight of the endless belt. In FIG. 2, for example, the guide bars, only one of which is shown, are parallel to the flight between roller 14 and 13*b*. In this manner, the cutter slide 64 is capable of sliding on the guide bar 65 along the path of the web of cloth 6, as the web of cloth traverses from roller 14 to roller 13*b* (the longitudinal direction). The cutter slide 64 is an elongated C-shaped tube made of plastic or preferably of metal in which an elongated slot 66 is formed. Within the elongated C-shaped cutter slide 64 is a slidable T bar 67, as illustrated in FIG. 4, which securely supports the cutter knife as generally represented by reference numeral 68 in FIG. 3. The knife cutter includes a rotary cutter 70 which is driven by a motor 69. Additionally, a finger lift 71 is secured to the knife cutter 68 for lifting the web of cloth 6 from the belt 15. The finger lift 71 tapers to a smooth point or edge in the cutting direction of the knife. The cutter knife 68 is capable of shifting from one edge of belt 15 to the opposite edge, and vice versa, by means of a cable 72, shown in part in FIG. 3, and fastened to the cutter knife 68 by any known fastener. Cable 72 is in the form of a continuous loop and is maintained in loop form by a pair of pulleys (not shown). A reversible motor 73 shifts cable 72 in either direction, thus reciprocating knife 68 along the longitudinal direction of cutter slide 64. Motor 73 is controlled by control 75. The direction of the knife is determined by a pair of limit switches 76 (only one of which is shown in FIG. 3) which is actuated by either the forward spear 77 or the rear spear 78, both of which are mounted upon the cutter knife 68. The limit switches 76 are positioned adjacent the guide bar 65 so that the cutter knife reciprocates substantially the entire distance between the guide bar 65. However, the limit switches may be positioned on a turn buckle secured to the guide bar 65 so that they can be adjusted to each edge of the web 6 of cloth in order to permit the cutter knife 68 to reciprocate only the distance necessary when a bolt of cloth is more narrow than usual. Control 75 energizes each limit switch 76. As stated previously, control 75 also controls motor 73. When control 75 activates the reversible motor 73, the cutter knife 68 is shifted from one edge of the web of cloth to the opposite edge where the forward spear 77 engages the forward position limit switch, causing motor 73 to reverse its direction of rotation, thus reversing the direction of the cutting knife 68. When rear spear 78 contacts the rear limit switch 76, the direction of rotation of motor 73 is again reversed, thus causing the cutter knife 68 to proceed in the forward direction. At this point, control 75 de-energizes the reversible motor 73 and the limit switches 76 and causes the cutter knife 68 to stop until it is desired to sever the cloth once again.

A vacuum pad 79 is mounted adjacent one edge of the web of cloth 6 by means of support brackets 80 (only one of which is shown in FIG. 3) which are securely fastened to and carried by the cutter knife 68. The support brackets 80 are pivotable with respect to the cutter knife 68 so that the vacuum pad 79 can be lifted upwardly by the finger lift 71. The degree to which the support brackets 80 pivot with respect to the cutter knife 68 is detected by a sensor 81, which in turn relays the detected position to control 75. Vacuum pad 79 is fluidly connected with a corrugated hose 82, which in turn is directly coupled with a vacuum pump motor 83, also mounted upon the cutter knife 68, as illustrated in FIG. 3. At the juncture of the vacuum pad 79 and the hose 82 is a quick activating valve 84, such as a gate valve, communicating the pump motor 83 with the vacuum pad 79. The quick activating valve 84 is opened or closed by control 75. Additionally, the vacuum motor 83 is regulated by control means 75. In general, vacuum pump motor 83 is always activated if the cloth spreading machine is activated. However, the position of the quick activating valve 84 is directly determined by control 75 which in turn functions to open or close the valve 84 based upon the position of the cutter knife 68. The position of the cutter knife 68 can easily be determined by, for example, calculating the number of revolutions of reversible motor 73 which would determine the direction and extent of the cutter knife 68 with respect to the starting position. Optionally, a series of photo electric eyes could be employed which would constantly monitor the position of the cutter knife 68 and relay the information to control 75. The function and operation of the cutter knife 68 and the vacuum pad 79 will be explained more fully when describing the operation of the overall device.

FIG. 4 illustrates the position of the cutter slide 64 and the perforated endless belt 15 along with one pair of solenoid switches 85 positioned at one end of the cutter slide 64, adjacent one guide bar 65, and positioned both above and below the cutter slide. An additional pair of solenoid switches, not shown, are positioned at the opposite end of the cutter slide 64 adjacent the opposite guide bar 65. The pair of solenoid switches 85 are activated by control 75 as schematically illustrated in FIG. 3. The solenoid switches 85 are slidably attached to the guide bars 65 so that they are capable of reciprocating with the cutter slide 64 as desired. The solenoids switches 85, when activated, clamp belt 15 thus causing the solenoid switches 85 to move along with the flight of the cloth and along the guide bars 65. Because each pair of solenoid switches 85 is securely attached to a support bracket 86 which is slidably mounted on the guide bars 65, and because the cutter slide 64 is also secured to the support bracket 86, the cutter slide, solenoid switches and support bracket reciprocate along the guide bars 65 as one unit, whenever the solenoid switches 85 are activated to clamp the web of cloth onto the endless belt. Each solenoid switch 85 may include a plate 87 when incorporated on the FIG. 5 embodiment. The hinged plates 87 are perpendicular to the solenoid bars 87*a* and permit the belt 15 to be moved away from the solenoid switches 85 and cutter knife system 62, as will be explained more fully later.

Operation of the cloth spreading machine of the present invention is commenced by first loading the bolt 5 of cloth into the loader throat 9. The web 6 from the bolt 5 is brought into contact with the feed roller 12. The rollers 11–14, 20–22 and the vacuum means 10 are activated with the shutter 18 open so that the web 6 will be drawn to the belt 15 and subsequently to the belt 23, thus feeding the cloth through the cloth spreading machine. Once the cloth is initially fed onto belt 15, the machine is temporarily deactivated so that the edge control means 16 may be properly positioned and the shutter 18 closed.

The bolt 5 is rotated by feed rollers 11 and 12 to make the web 6 of cloth available. The web 6 advances through the edge control means 16; if an out-of-line condition is sensed, the bolt 5 will be axially adjusted to position the web 6, as is conventionally known. The web 6 is then drawn against the belt 15 at perforated roller 14 by the air suction produced by the vacuum means 10. The overlying web 6 is made to contract as it passes through the contraction section of the belt 15 between rollers 14 and 13*b*, as previously discussed. This removes any tension in the web 6 that might exist due to the manner in which the bolt 5 was wound at the textile mill. As the web 6 comes in contact with the perforated belt 23, the vacuum drawn from within the spreading unit 8 pulls the web against the belt 23. The web remains in contact with the belt 23 until it passes over roller 21 or 22, depending on the direction of travel of the machine. Thus, a straight edge is maintained from the time the web 6 is positioned by the edge control means 16 until it is laid onto the spreading table 3.

As the cloth spreading machine approaches one end of table 3, it may be desirable to sever the cloth so that the individual layers of the web of cloth are stacked vertically upon one another in perfect fashion. Under normal circumstances, the cloth spreading machine normally traverses the table at a speed of about 120 yards per minute. As the machine approaches either end of the table, the machine deaccelerates until it completely stops at one end of the table. The deacceleration of the machine starts when there is approximately 5 feet remaining in the reciprocation path of the cloth spreading machine. When the machine has one and one/half foot remaining in its traverse, the control 75 activates the cutter motor 69 and reversible motor 73 which causes the cutter blade 70 to rotate and causes the cutter knife 68 to advance toward the cloth edge, respectively, as shown in FIG. 3. Simultaneously, control 75 activates solenoid switches 85 causing each solenoid to clamp the belt 15 on each side edge, so that the cutter knife system 62 now shifts downwardly with the belt 15 by sliding on guide bars 65. The vacuum pump motor 83 is energized, so long as the cloth spreading machine is energized, thus always providing vacuum suction within hose 82. The control 75 additionally activates valve 84 to the open position causing the vacuum pad 79 to pick up on the cloth so that the finger 71 can be slipped between the web of cloth 6 and the perforated endless belt 15, as the cutter knife further advances. Once the cutter knife 68 has advanced a sufficient distance so that the finger 71 is beneath the cloth, finger 71 raises the vacuum pad 79 and arm 80 causing sensor 81 to sense the raised position and thus signal control 75 to deactivate the valve 84 to the closed position causing the cloth to drop on finger 71. The cutter knife 68 is further advanced by a conventional screw shaft or cable drive 72 in the longitudinal direction of the cutter slide 64 from one guide bar 65 to the opposite guide bar 65. The cutter knife 68 severs the cloth completely when the cloth spreading machine has approximately 6 to 10 inches remaining in its travel to the end of table 3.

When the cloth is completely severed, the forward spear 77 of the cutter knife 68 punches the limit switch 76 adjacent guide bar 65 (limit switch and guide bar associated with spear 77 not shown) which signals control 75 to reverse the motor 73 so that the cutter knife is retracted to the opposite end of the cutter slide 64. When spear 77 punches limit switch 76, control 75 simultaneously deactivates all the solenoid switches 85 so that the cutter slide, cutter knife and solenoid switches no longer travel in the direction of movement of the web of cloth. A spring or other conventional means (not shown) returns the cutter knife, cutter slide and solenoid switches to a position upstream of the flight of cloth, to its rest position.

When the cutter knife 68 reaches the starting end of its path of travel, the rear spear 78 punches the limit switch 76 adjacent guide bar 65, as shown in FIG. 3, thereby signaling control 75 to reverse the motor 73 of the cutter knife 68 to advance it a slight distance to its starting position whereupon the control deactivates the cable motor 73. Simultaneously, the cloth spreading machine 1 has reached the end of its path and has completely spread one layer of cloth either upon the table 3 or upon another ply of cloth.

During the entire operation of the cloth spreading machine, the steam sparger 60 continuously moistens the cloth in order to relax the web of cloth 6. Additionally, motor 58 continually reciprocates jiggle rollers 55–57 causing them to reciprocate along the transversal width of the cloth in order to aid in relieving the stress or tension of the cloth.

Upon completion of the lay of the web 6 of cloth, the elevator means 24 is activated to raise the spreading unit 8 an increment substantially equal to the thickness of the web 6 of cloth just laid. At this point, the direction of motion of the cloth spreading machine may be immediately reversed, thus spreading cloth in both directions, if desired. Depending upon the type of cloth, it may be desirable to rotate the cloth spreading machine on frame 1 before reversing the machine in order to assure that the weave or nap of the cloth, for example, corduroy, has the proper orientation when the pattern is cut. Sometimes it is necessary to swing the spreading unit 8 away from the cloth supply feed mechanism 4 in order to rotate the machine. In those instances, the spreading unit 8 is swung in an arc indicated by arrow C and shown in phantom in FIG. 2.

Figure 5:
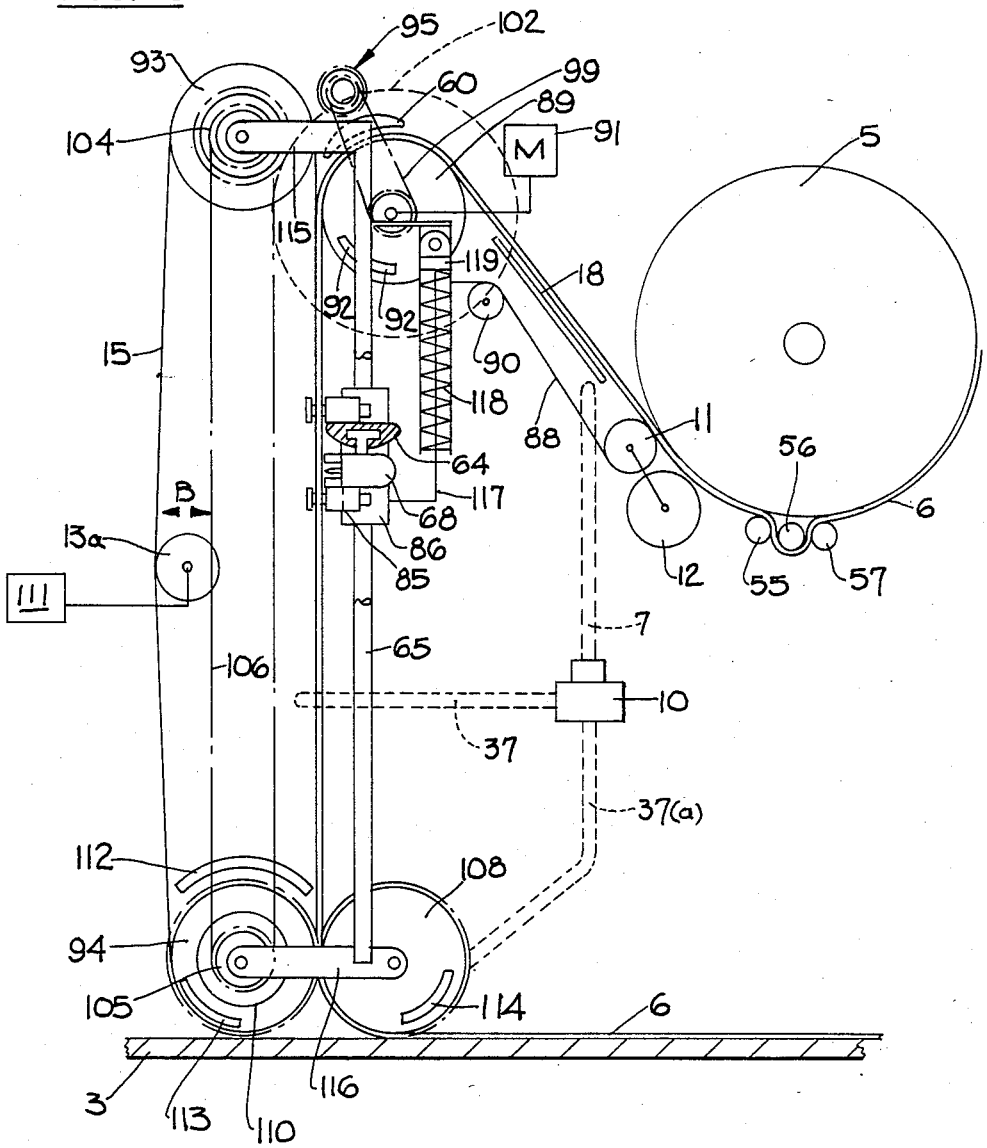
FIG. 5 is a diagrammatic side view of another embodiment of the cloth spreading machine of the present invention.

FIG. 5 represents a modification of the cloth spreading machine of the present invention. Reference numerals common to both FIGS. 1 and 5 represent the same common elements. A bolt of cloth 5 is positioned immediately above a plurality of jigger rollers 55, 56 and 57 which perform the same function specified with respect to the FIG. 1 device. Additionally, feed rollers 11 and 12 also perform the same function as described with respect to the FIG. 1 device. A perforated endless belt 88 is made of the same material as belt 15 and is generally the same width or slightly larger than the width of the cloth being spread. Belt 88 travels about roller 89 approximately 290° about its circumference. The belt then travels around roller 90 which merely serves to redirect the direction of the belt so that it more fully contacts feed roller 11. Like the cloth spreading machine illustrated in FIG. 1, roller 89 of the FIG. 5 modification is the drive roller for endless belt 88 and is powered by the carriage drive motor 91, for example.

The interior of endless belt 88 is closed by means of sidewalls (not shown), similar to sidewalls 34 illustrated in FIG. 1. In this manner, a vacuum pump 10 can draw a vacuum through line 7 shown in phantom in FIG. 5 to create a vacuum chamber within the interior of endless belt 88. Roller 89 is perforated so that the vacuum may also be drawn through the roller 89 and through the endless belt 88. Roller 89 has a vacuum block 92 to prevent the vacuum within roller 89 from returning the cloth.

A steam sparger 60 is positioned above roller 89 and functions in the same manner, for the same purpose, as the steam sparger in FIG. 1.

Figure 6:
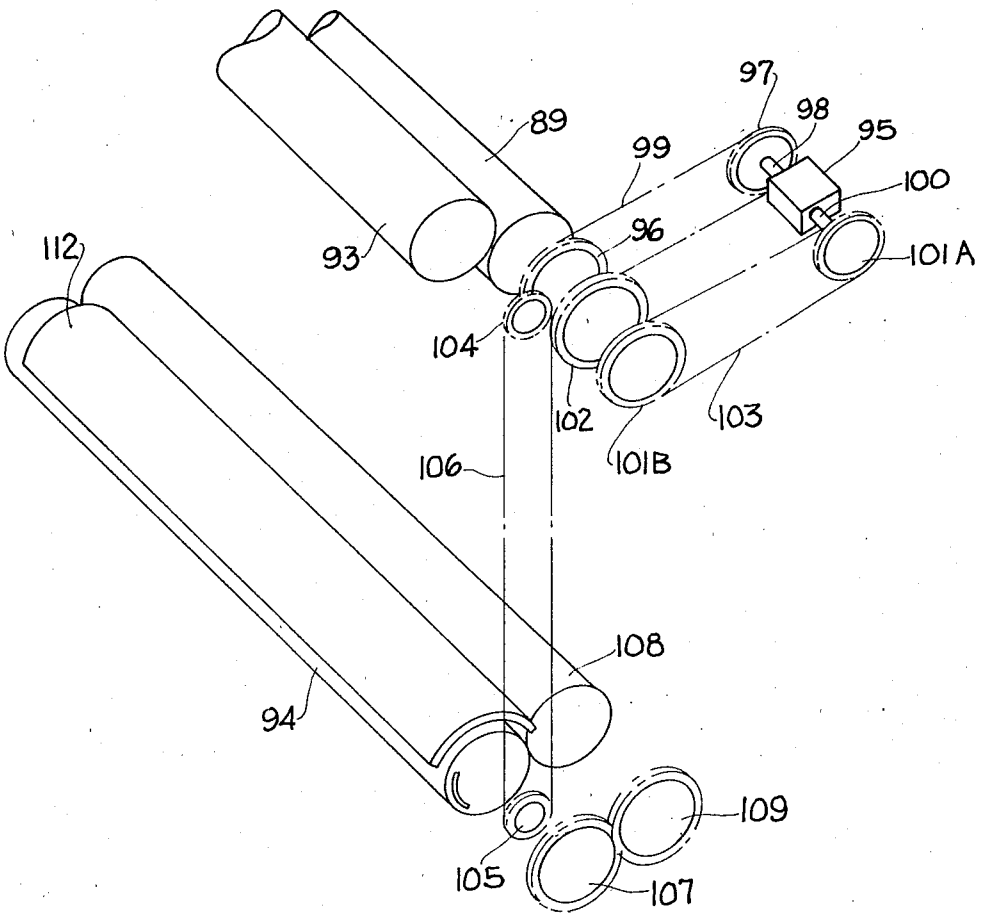
FIG. 6 is a fragmentary perspective view of the main rollers of the FIG. 5 embodiment.

A vertically positioned endless belt 15 traverses rollers 93 and 94 in an endless path. Roller 93 is powered by a speed differentiator 95, as illustrated in FIG. 6, which in turn is powered by roller 89. For example, roller 89, which is powered by the carriage drive 91, includes a sprocket 96. The speed differentiator 95 has a sprocket 97 attached to its input shaft 98. A chain 99 endlessly traverses about sprockets 96 and 97. The output shaft 100 of the speed differentiator 95 has a sprocket 101*a*. Roller 89 has a sprocket 101*b* which is in alignment with the sprocket 101*a*. A chain 103 endlessly traverses about sprockets 101*a* and 101*b*. Roller 101*b* is free wheeling with respect to roller 89. Roller 89 also has a sprocket 102, generally between roller 96 and 101*b* which is free wheeling with respect to roller 89, but is rotative with sprocket 101*b*. Roller 93 also includes a second sprocket 104. Roller 94 includes a sprocket 105 which is in alignment with sprocket 104 of roller 93. A chain 106 endlessly traverses about sprockets 104 and 105. Sprocket 102 is positioned to engage chain 106 so as to rotate roller 93. Sprocket 105 is free wheeling with respect to roller 94. Roller 94 also includes a toothed gear wheel 107 which is free wheeling with respect to roller 94 but is synchronously locked to the rotation of sprocket 105. Roller 108 also includes a toothed gear 109 which is in alignment with and designed to mesh with the toothed gear 107. Rollers 89, 93, 94 and 108 may be equipped with a plurality of sprockets and toothed gears on each end of each roller or on just one end of each roller, as is illustrated in FIG. 6.

Roller 89, which is powered by the carriage motor 91 causes sprocket 96 to rotate thus rotating sprocket 97 thereby powering the speed differentiator 95. The output shaft 100 of the speed differentiator 95 rotates sprocket 101*a* which in turn rotates sprocket 101*b* by means of the chain 103. Sprocket 101*b* is rotatively secured to sprocket 102. Both sprockets 101*b* and 102 are free wheeling with respect to roller 89. Roller 93 is securely fastened to sprocket 104 thereby rotating sprocket 105 by chain 106. Sprocket 102 engages chain 106 thereby driving roller 93 and sprockets 104 and 105. Sprocket 105 drives toothed gear wheel 107, which in turn drives toothed gear 109, thus causing roller 108 to rotate at the same speed as roller 93. This arrangement permits the roller 89 to be driven, for example, at a speed slightly greater than the speed of roller 93. This permits 100 feet of cloth to be condensed to 98 feet of cloth, for example.

The reason sprocket 105 and toothed gear 107 are free wheeling with respect of roller 94 is that roller 94 is momentarily interrupted by a friction clutch 110, as shown in FIG. 5, which is similar in function and purpose to friction clutch 33, illustrated in FIG. 2.

Positioned between rollers 93 and 94 is small roller 13*a* designed to be shifted along the direction of arrow B as shown in FIG. 5. Roller 13*a* performs the same function on the endless belt 15, as roller 13*a* in FIG. 2. Moreover, the FIG. 5 embodiment includes a control 111, which may be either manual or automated, and shifts the roller 13*a* either inwardly or outwardly depending upon the relationship between rollers 93 and 94 with respect to roller 89. For example, when roller 89 is positioned midway between rollers 93 and 94 (a condition which occurs after a multitude of layers of cloth have been spread), the cloth transferring from roller 89 to bolt 15 only contacts about half the cloth carrying flight. The condensing that takes place at this point in time must be equal to the condensing that occurs when the cloth spreading machine is positioned as illustrated in FIG. 5. Consequently, it will be necessary to increase the condensing by creating more slack in belt 15. This is accomplished by moving roller 13*a* to the right, as viewed in FIG. 5, by control 111.

The interior of endless belt 15 is closed to the exterior by means of the sidewalls (not shown) which are similar in nature and function to sidewalls 34, illustrated in FIG. 1. The sidewalls serve to form a vacuum chamber within the interior of the endless belt 15 produced by vacuum pump 10 through line 37 shown in phantom in FIG. 5. Additionally, roller 94 is perforated so that a vacuum is drawn through the roller and simultaneously through the endless belt 15. However, roller 94 includes an openable and closeable arcuate shutter 112 operated by control 75 and designed to permit or block the vacuum force to operate on roller 94.

A vacuum is drawn through roller 108 by means of a vacuum line 37*a*, which is coupled with vacuum means 10. Each of rollers 89, 94 and 108 are provided with an elongated arcuate baffle plate 92, 113 and 114 designed to block the vacuum in a lower circumferential area of each roller. Within roller 89, the arcuate baffle plate 92 is positioned at the lower quadrant of the roller adjacent belt 15 and guide bar 65. The baffle plate 92 operates to block the vacuum within the roller so that the cloth is not persuaded to follow the circumference of roller 89, but instead follows belt 15.

In viewing FIG. 5, when the cloth spreading machine is moving toward the left, the shutter 112 is closed, thus blocking the vacuum force from roller 94. This permits the cloth traveling down belt 15 to follow the circumference of roller 108, due to the vacuum in roller 108, enabling the cloth to be laid in a flat, tensionless manner. Block 114 prevents the cloth from continuing to follow the circumference of roller 108. When the cloth spreading machine is moving toward the right, the shutter 112 is opened, permitting a vacuum to be transmitted through porous roller 94. Additionally, the vacuum in conduit 37*a* is terminated so that roller 108 is no longer under a vacuum force. This permits the cloth traveling down belt 15 to follow the circumference of roller 94, enabling the cloth to be laid in a flat, tensionless manner. Block 113 prevents the cloth from following the circumference of roller 94.

Roller 93 is coupled to a pair of draw bars 115, only one of which is illustrated in FIG. 5. Likewise, rollers 94 and 108 are coupled together in a non-rotative fashion by a pair of draw bars 116, only one of which is shown in FIG. 5. Stretching between draw bars 115 and 116 are a pair of guide rods 65 (only one of which is shown) onto which a cutter slide 64 and support bracket 86 are slidably attached. Two pairs of solenoid switches 85 (only one pair of which is illustrated) and the cutter knife 68 are secured to the support bracket 86 as described with respect to FIGS. 3 and 4. In this manner all solenoid switches 85, cutter slide 64 and the cutter knife 68 reciprocate with one another as a rigid unit.

Attached to support bracket 86 is a rod 117. A spring 118 surrounds rod 117 and abuts against piston 119 secured to one end of rod 117. When the solenoid switches 85 clamp the web 6 of cloth to pull the support bracket 86 downwardly, rod 117 is also pulled downwardly along with piston 119. When the solenoid switches are deactivated, the spring 118 returns the support bracket 86 to its normal rest position. Piston 119 acts as a damper when the spring 118 returns the cutter knife and support bracket 86 to the rest position to prevent the support bracket 86 from being violently jolted when it reaches the rest position.

Operation of the FIG. 5 modification is similar to the operation of the FIG. 1 modification. Operation is commenced by first loading the bolt 5 of cloth onto the cloth spreading machine. The web 6 of the bolt 5 is brought into contact with feed rollers 11 and 12 after it traverses jiggle rollers 55–57. The web of cloth 6 is then laid upon the endless belt 88 and vacuum means 10 is activated so as to draw a vacuum through endless belt 88 and through shutter 18 to hold the web of cloth 6 to the perforated belt. Additionally, roller 89 is activated by means of carriage motor 91 so that the endless belt 88 is rotated to advance the web 6 of cloth from feed roller 11 to roller 89. When the web of cloth reaches the upper part of roller 89, it is steamed by steam sparger 60 in order to relax the cloth as previously explained. Once the cloth is fed past roller 89, the shutter 18 is closed to block the vacuum so that the cloth can be aligned. The shutter 18 remains closed during the remaining operation, i.e., it is only opened during feeding of the cloth from bolt 5.

Roller 13*a* is then extended to the left as viewed in FIG. 5 until the limit straps (not shown) are tightly extended. At this point, roller 13*a* is retracted to a position creating slack in belt 15. The amount of slack depends on the cloth and on the amount of condensing to occur. Retraction of roller 13*a* creates a condensing portion in perforated endless belt 15 between roller 93 and 94 on the cloth carrying flight (the flight facing the cutter knife system 62). The web 6 of cloth is transferred from belt 88 to belt 15 due to the vacuum chamber within the interior of belt 15. Block 92 prevents the cloth from following the circumference of roller 89. In this manner, the cloth is relaxed in the condensed portion of the endless belt 15 so that the tension of the cloth is reduced in much the same manner as described with respect to the FIG. 1 apparatus.

As the cloth spreading machine lays the cloth upon the table, it approaches one end of the table causing control means 75, as shown in FIG. 3, to activate the solenoid switches 85 causing them to clamp the perforated endless belt 15 so that the cutter knife system 62 travels with the belt 15. Additionally, control 75 activates the cutter knife 68 in much the same manner as explained previously, to sever the cloth. When the cloth is severed and the cutter knife and solenoid switches are returned to their normal position, the last bit of cloth is laid upon the table 3 and the cloth spreading machine comes to a complete stop to reverse its direction in order to lay another ply of cotton. At the time the cloth spreading machine comes to a complete halt, motor 120 (illustrated in FIG. 3) is activated by control 75, which elevates the entire cloth spreading machine illustrated in FIG. 5, a slight amount to take into account the thickness of the cloth being spread. If the entire cloth spreading machine is elevated, it is not necessary to change the tension in belt 15 and, consequently, it will not be necessary to change the setting on control 111.

In a slightly different embodiment, motor 120 elevates rollers 93, 94 and 108 an incremental amount at the completion of each lay of cloth. After a multitude of plys of cloth have been laid, roller 89 will then transfer cloth 6 to belt 15 midway between rollers 93 and 94, for example. Because it will be necessary to lay each ply of cloth to the same uniform condensing level, it will be necessary to adjust the tension in the belt 15 at the completion of each lay of cloth. This is achieved by control 111 which moves roller 13*a* inwardly (to the right as illustrated in FIG. 5) an incremental amount sufficient to create additional slack in the cloth carrying flight of belt 15, thereby achieving the same condensing level in each lay of cloth.

Depending upon the type of cloth, it may be necessary to rotate the cloth so that the nap of the cloth is consistent with each ply. Rotating the cloth is well known, however, rotation with the present device is distinctly different. In order to rotate the cloth, the solenoid switches 85 have a plate 87 which is hinged for the FIG. 5 embodiment. The plate 87 may either be in the clamping position, as illustrated in FIGS. 4 and 5, or the plate may be opened and in axial alignment with portion 87*a*. Control 75 regulates the position of plate 87. Spring loaded hinges or magnetic hinges, for example, could be employed thereby permitting control 75 to regulate the position of plate 87. When it is necessary to rotate the cloth, the hinged plates 87 are opened thereby permitting the rollers 93 and 94, along with the endless belt 15, to physically move away from the remainder of the cloth spreading machine so that the cloth may be rotated. This may be achieved by pivoting about roller 93, for example, so that roller 94 swings in an arc away from the remainder of the cloth spreading machine. After the cloth has been rotated and rollers 93 and 94, along with belt 15, are repositioned adjacent solenoid switches 85, control 75 can activate the hinge plate 87 such that they once again tuck behind belt 15.

Modification of the present invention can be made without departing from the spirit of it. For example, instead of employing a cutter knife as described previously, a conventional hot wire could be employed to sever the cloth by burning through its thickness. In order to prevent the cloth from catching on fire, an inert, non-oxidizing, non-combustible gas, such as argon or nitrogen, may be diffused along the entire length of the wire. Like the cutter knife, the hot wire and diffuser for the gas are secured to the guide bars 65 so that the entire system moves with the cloth, as previously described.

What is claimed is:

1. A combination cloth supply feed mechanism and a cutter knife for removing tension from cloth obtained from a supply of cloth and severing said cloth for forming multi-layers of cloth comprising:

a feed roller to control the rate at which the cloth is removed from said supply of cloth;

first and second tension adjustment rollers;

a perforated endless belt; said perforated belt passing about said feed roller and said first tension adjustment roller with a non-slipping engagement forming cloth carrying and return flights therebetween;

said second tension adjustment roller being shiftably mounted between a normal position adjacent said return flight and an actuated position engaging and stretching said return flight;

means to shift said second tension adjustment roller between said normal and said actuated positions;

means to drive said feed roller;

a friction clutch in association with said first tension adjustment roller so that said first tension adjustment roller is rotated by said belt only; and cutter means to sever the cloth;

whereby when said second adjustment roller is positioned from said normal position to said actuated position, said return flight of said belt is stretched, and when said second adjustment roller is rapidly returned to its normal position, said first adjustment roller is momentarily stopped, causing the stretch of said return flight to be taken up by said feed roller whereby slack is created in said cloth carrying flight converting said cloth carrying flight to said condensing section, said cloth being severed by said cutting means at the end of said condensing portion.

2. The combination claimed in claim 1, wherein said endless belt includes at least one limit strap which limits the expansion of said belt and does not interfere with the contraction of said belt.

3. The combination claimed in claim 1, wherein said mechanism has a pair of end walls with said rollers positioned therebetween, and means for drawing a vacuum in the space bound by said pair of end walls and said perforated endless belt.

4. The combination claimed in claim 1, wherein said cutter means comprises a cutter knife and a cutter slide, wherein said cutter knife reciprocates along the longitudinal length of said cutter slide.

5. The combination claimed in claim 4, wherein said cutter slide is positioned normal to the path of said carrying flight.

6. The combination claimed in claim 5, further including two pairs of solenoids rigidly mounted with respect to said cutter slide, wherein one pair of solenoids are positioned at one edge of the cloth while said other pair of solenoids is positioned at said other edge of cloth.

7. The combination as claimed in claim 6, wherein each pair of solenoids includes a solenoid position downstream with respect to the cloth carrying flight adjacent the cutter slide, while said other solenoid of said pair is positioned upstream of said cutter slide.

8. The combination claimed in claim 7, further including a cutter knife means including means to move said knife along the longitudinal direction of said cutter slide, said control means designed to control said solenoids and said cutter knife means.

9. The combination claimed in claim 8, including a pair of guide bars positioned adjacent each edge of said cloth parallel with said cloth carrying flight, said cutter slide and said two pairs of solenoids being slidably connected to said guide bars, so as to slide in a reciprocating fashion along with and against the direction of the cloth carrying flight.

10. The combination claimed in claim 9, further including a return means for returning said cutter slide, said cutter knife, and said two pairs of solenoids to the initial starting position.

11. The combination as claimed in claim 4, further including a vacuum pad positioned adjacent one edge of said cloth on said cloth carrying flight just ahead of said cutter means.

12. The combination as claimed in claim 4, wherein said cutter knife includes a cutter finger connected to said cutter knife so as to project ahead of said cutter knife as it severs cloth, and further including a vacuum pad positioned adjacent one edge of said cloth on said cloth carrying flight just ahead of said cutter means, wherein said control operates said vacuum pump to lift said cloth upon said cutter finger at initial activation of said cutter knife.

13. The combination claimed in claim 12, further including a steam sparger positioned immediately above said feed roller in order to steam said cloth as it is unrolled from said cloth supply roller.

14. The combination claimed in claim 13, further including at least two jiggle rollers positioned beneath said bead roller, said jiggle rollers including means to reciprocate said jiggle rollers in a longitudinal direction across the width of said cloth as said cloth is wound between said jiggle rollers.

15. The combination cloth supply feed mechanism and steam sparger for removing tension from cloth obtained from a supply of cloth comprising:

a feed roller to control the rate at which the cloth is removed from said supply of cloth;

first and second tension adjustment roller;

a perforated endless belt; said perforated belt passing about said feed roller and said first tension adjustment roller with a non-slipping engagement forming cloth carrying and return flights therebetween;

said second tension adjustment roller being shiftably mounted between a normal position adjacent said return flight and an actuated position engaging and stretching said return flight;

means to shift said second tension adjustment roller between said normal and said actuated positions;

means to drive said feed roller;

a friction clutch in association with said first tension adjustment roller so that said first tension adjustment roller is rotated by said belt only;

a steam sparger positioned so as to supply steam to said cloth immediately before said cloth carrying flight, whereby when said second adjustment roller is positioned from said normal position to said actuated position, said return flight of said belt is streched and when said second adjustment roller is rapidly returned to its normal position, said first adjustment roller is momentarily stopped, causing the stretch of said return flight to be taken up by said feed roller whereby slack is created in said cloth carrying flight converting said cloth carrying flight to said condensing portion.

16. The combination claimed in claim 15, further including at least two jiggle rollers, said jiggle rollers including means to reciprocate said rollers transversely across the width of said cloth, said jiggle rollers positioned so that supply of cloth traverses between them and before said cloth carrying flight.

* * * * *